US008138973B2

(12) United States Patent
Kinghorn et al.

(10) Patent No.: US 8,138,973 B2
(45) Date of Patent: Mar. 20, 2012

(54) PHASED ARRAY ANTENNA

(75) Inventors: Anthony Kinghorn, Midlothian (GB); Ronald Lyon, Midlothian (GB); Angus McLachlan, Midlothian (GB); Graeme Morrison, Midlothian (GB)

(73) Assignee: Selex Galileo Ltd, Basildon, Essex (GB)

( * ) Notice: Subject to any disclaimer, the term of this patent is extended or adjusted under 35 U.S.C. 154(b) by 337 days.

(21) Appl. No.: 12/309,853

(22) PCT Filed: Jul. 26, 2007

(86) PCT No.: PCT/GB2007/050443

§ 371 (c)(1),
(2), (4) Date: Feb. 2, 2009

(87) PCT Pub. No.: WO2008/015472

PCT Pub. Date: Feb. 7, 2008

(65) Prior Publication Data

US 2010/0238071 A1 Sep. 23, 2010

(30) Foreign Application Priority Data

Aug. 3, 2006 (GB) ..... 0615389.4

(51) Int. Cl.
*H01Q 3/00* (2006.01)

(52) U.S. Cl. ..... 342/368

(58) Field of Classification Search ..... 342/81, 342/157, 368, 372, 373
See application file for complete search history.

(56) References Cited

U.S. PATENT DOCUMENTS

| | | | |
|---|---|---|---|
| 5,093,667 | A | 3/1992 | Andricos |
| 5,412,414 | A | 5/1995 | Ast et al. |
| 6,144,339 | A | 11/2000 | Matsumoto et al. |
| 6,469,671 | B1 | 10/2002 | Pluymers et al. |

FOREIGN PATENT DOCUMENTS

WO WO 98/10309 3/1998

OTHER PUBLICATIONS

International Search Report for PCT/GB2007/050443, mailed Oct. 8, 2007.
Kinzel, J. A. et al., "V-Band, Space-Based Phased Arrays", Microwave Journal, vol. 30, No. 1, (Jan. 1987), pp. 89-90, 92, 94, 9.
Parker, D. et al., "Phased Arrays-Part I: Theory and Architectures":, IEEE Transactions on Microwave Theory and Techniques, vol. 50, No. 3, (Mar. 2002), pp. 678-687.
Feldle, H. P. et al., "Transmit/Receive Modules for X-Band Airborne Radar", Radar '97, (Oct. 14-16, 1997), pp. 391-395.
Tang, R. et al., "Array Technology", Proceedings of IEEE, vol. 80, No. 1, (Jan. 1992), pp. 173-182.

*Primary Examiner* — Dao Phan
(74) *Attorney, Agent, or Firm* — Buchanan Ingersoll & Rooney PC

(57) ABSTRACT

This invention relates to utilizing a larger number of lower power transmit/receive modules in a phased antenna array in order to utilize cheaper and simpler transmit/receive modules whilst retaining comparable power per unit area as can be achieved through using conventional high powered transmit/receive modules. The advantage of this arrangement is that cheaper antenna arrays can be constructed without limiting the capability and/or performance of a system incorporating such an array when compared to a conventional solution.

10 Claims, 4 Drawing Sheets

PHASED ARRAY ANTENNA

This application is the U.S. national phase of International Application No. PCT/GB2007/050443, filed 26 Jul. 2007, which designated the U.S. and claims priority to Great Britain Application No. 0615389.4, filed 3 Aug. 2006, the entire contents of each of which are hereby incorporated by reference.

FIELD

This invention is concerned with alleviating the need for high power transmit/receive modules in phased array antennas and therefore reducing the cost of such array antennas.

BACKGROUND

The general trend in the art, when constructing phased array antennas, is to determine the highest operating frequency of an antenna to be constructed and, based on the requirements for spacing the radiating elements that result from this selected operating frequency, placing radiating elements coupled to transmit/receive modules at exactly this spacing to minimise the number of transmit/receive modules used. However, to obtain high-powered phased array antennas using this methodology, the skilled person is inclined to utilise the highest powered transmit/receive modules available. However, this is not a very cost-effective method of constructing a phased array antenna, as high power transmit/receive modules are usually very expensive.

SUMMARY

Accordingly, the present invention provides a phased array antenna comprising: a plurality of communication modules; wherein a power density of said phased array antenna is equivalent to a power density of a second antenna that has fewer, higher power communication modules than the said phased array antenna.

Preferably, each antenna element is connected to a communication module implemented as a highly integrated unit using a very small number, ideally one or two, integrated circuits.

The communication module is preferably a transmit and/or receive module.

The advantage of the present invention is that, by increasing the number of transmit/receive modules at the same time as increasing their density over the array face, less powerful modules can be used, which significantly reduces the cost of the array in total as each module becomes significantly simpler and cheaper, and the same or comparable power can be maintained per unit area of the array face.

DESCRIPTION OF THE DRAWING

Specific embodiments of the invention will now be described, by way of example only and with reference to the accompanying drawings that have like reference numerals, wherein.

A specific embodiment of the present invention is shown in FIGS. 1 to 5 and will now be described with reference to these Figures in more detail below.

DETAILED DESCRIPTION

Figure 1:
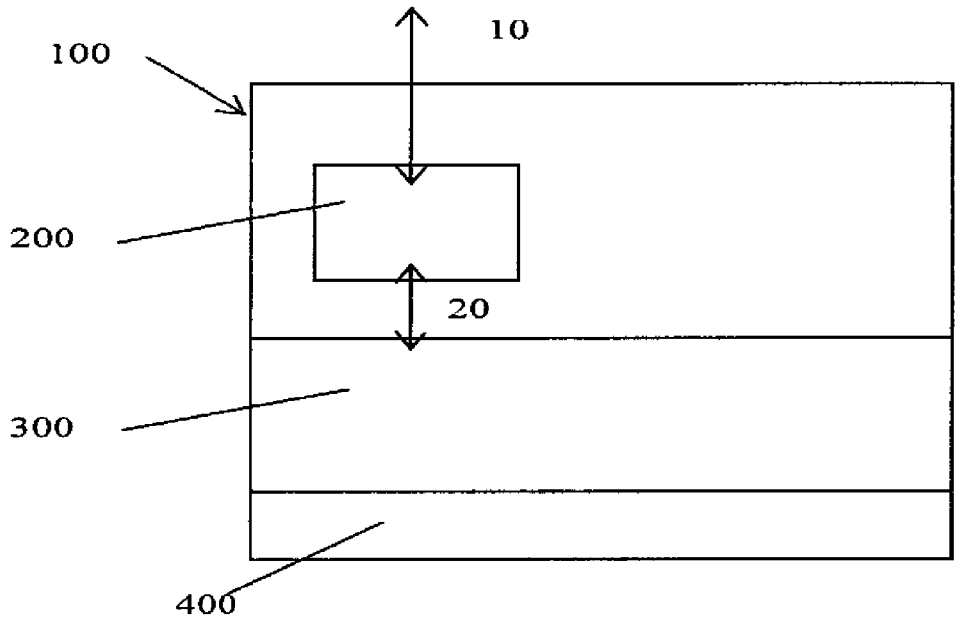
FIG. 1 is a schematic showing the basic structure of the array antenna.

FIG. 1 is a schematic diagram of an antenna apparatus according to the specific embodiment of the present invention. The antenna apparatus 100 has a processing portion 200 in communication (as shown by arrow 20) with an array portion 300. Processing portion 200 is, in turn, in communication (as shown by arrow 10) with an external system (not shown). Further, the array portion 300 has an array face 400 that is shown in FIGS. 2. and 3 and described in more detail below with reference to these figures.

Figure 2:
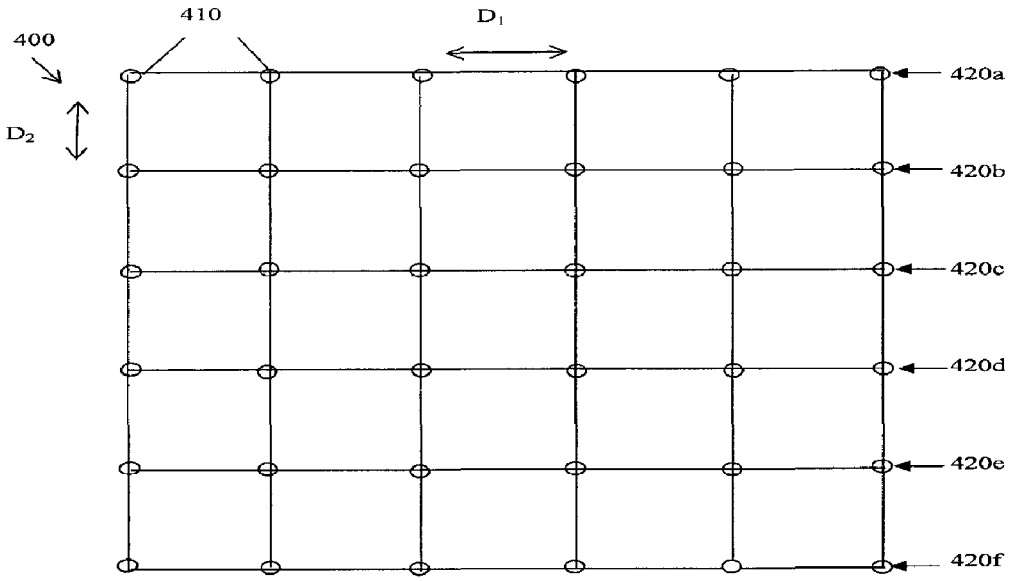
FIG. 2 is a diagram illustrating an exemplary structure of an array antenna face.

FIG. 2 shows the array face 400 of the specific embodiment of the invention. The array face 400 is made up of a grid of radiating elements 410, spaced equally with a width $D_1$ between each radiating element 410 in the horizontal direction and a width $D_2$ between each radiating element 410 in the vertical direction. This arrangement is facilitated by providing each row of the radiating elements 410 along linear structures 420*a* to 420*f*. The linear structures 420*a* to 420*f* are stacked so that each row of radiating elements 410 are in parallel with one another. Width $D_1$ may be equal to, or different from, width $D_2$.

Figure 3:
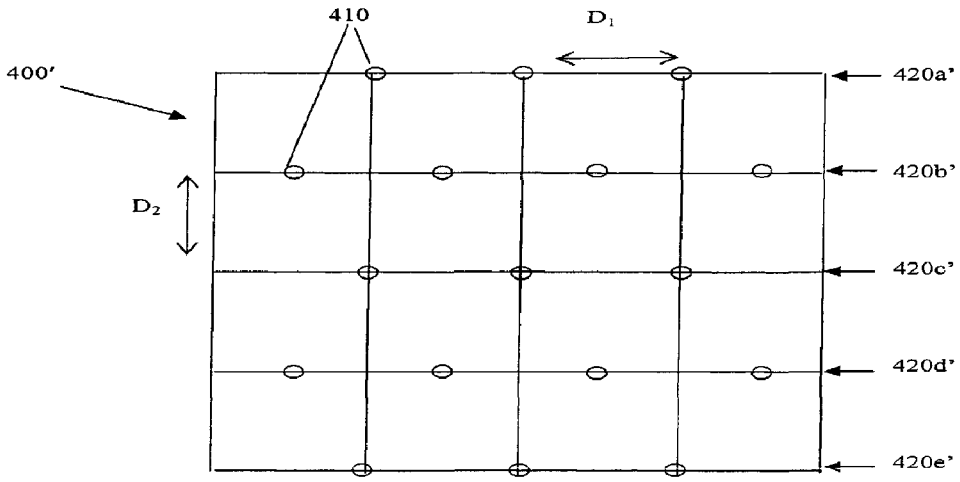
FIG. 3 is a diagram illustrating another example of a structure of an array antenna face.

FIG. 3 shows an array face 400' according to an alternative embodiment of the invention. The array face 400 is made up of an offset grid of radiating elements 410. Here, the radiating elements 410 are spaced equally with a width $D_1$ between each radiating element 410 in the horizontal direction. The difference from the specific embodiment shown in FIG. 2 is that, while there is a width $D_2$ between each row of radiating elements 410 in the vertical direction, adjacent rows of radiating elements are not aligned in the vertical direction. The arrangement is facilitated by providing each row of the radiating elements 410 along linear structures 420*a'* and 420*f'* which are stacked in parallel to one another but offset in the horizontal direction by half of width $D_1$ such that every other linear structure 420*a'*, 420*c'*, 420*e'*, and 420*b'*, 420*d'* of radiating elements 410 are aligned in the vertical direction. As with the specific embodiment shown in FIG. 2, the width $D_1$ may be equal to, or different from, width $D_2$.

In further alternative embodiments, as the offset of half of width $D_1$ between linear structures is an arbitrary choice, the skilled person would understand that many different offset arrangements could be used to implement the present invention.

Figure 4:
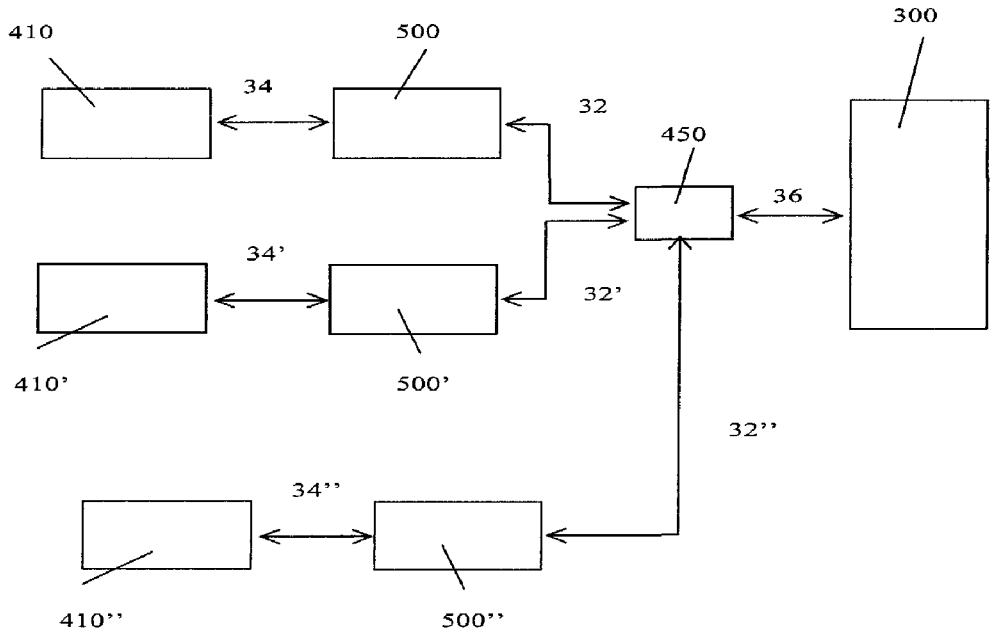
FIG. 4 is a diagram showing the configuration behind the elements of the array face.

Referring now to FIG. 4, which shows the configuration of the array antenna 100 behind the array face 400 on which the radiating elements 410 are located. This shows that each radiating element 410, 410', 410" is in communication with a transmit/receive module 500, 500', 500" (as shown by arrows 34, 34', 34") which is in turn in communication with combining element 450 (as shown by arrows 32, 32', 32"). Each combining element 450 is in turn in communication (as shown by arrow 36) with the main array portion 300. A plurality of transmit/receive modules 500 may be in communication with one combining element 450. Alternatively more than one combining element is then combined.

Figure 5:
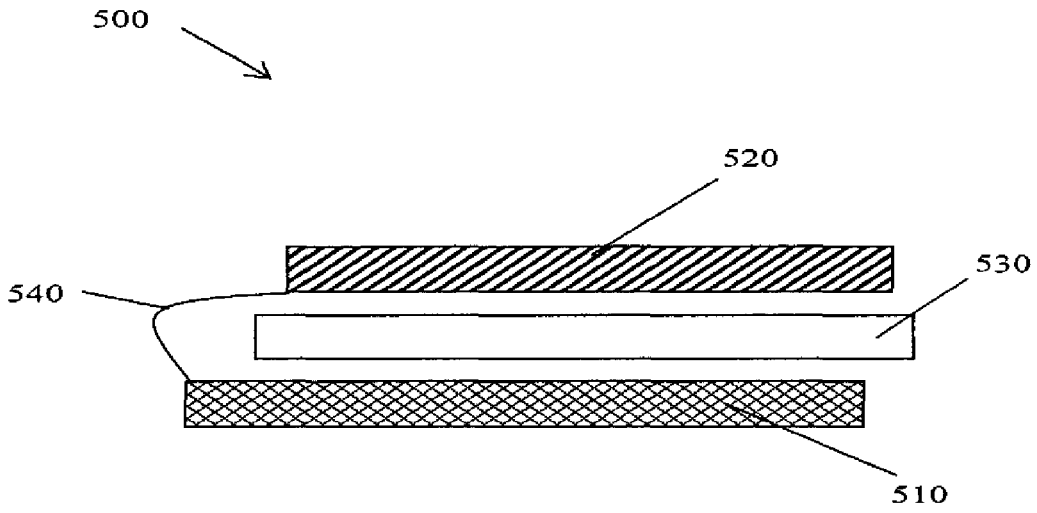
FIG. 5 is a diagram illustrating a possible two-chip transmit/receive module for use with an array antenna.

In the specific embodiment, with reference to FIG. 5, the transmit/receive module 500 takes the form of a two-chip solution. The transmit/receive module 500 comprises a Radio Frequency (RF) chip 510, preferably implemented in Gallium Arsenide or Gallium Nitride, connected by wire bonds 540 to Silicon chip 520. The chips 510, 520 are separated from each other by a ceramic shelf 530. The Gallium-Arsenide chip 510 is responsible for the radio frequency amplification, power generation and phase control while the Silicon chip 520 is responsible for any necessary digital control and housekeeping functions. In this arrangement, the RF chip 510 is mounted on a base plate (not shown) to dissipate any heat generated. An advantage of this solution is that each chip is suited to its application, whereas a single chip solution would compromise performance in either the digital control (if a Gallium-Arsenide chip) or radio frequency gain, amplification, power generation and phase control (if a Silicon chip).

Any solution a skilled person appreciates is relatively easy to manufacture can be used as an alternative to the above two-chip solution of the specific embodiment of the invention. For example, a one-chip solution may be preferred by the skilled person.

The method of configuring the layout of radiating elements on 410 on the array face 400 is determined by, firstly, the required power from the array antenna, and secondly, the required power per unit area that is required to accomplish this.

The required spacing D of the radiating elements 410 can therefore be determined from this calculation, in order to give the appropriate power per unit area needed by the antenna.

Using the determined value for the required power per unit area and required spacing D of the radiating elements, and with knowledge of the power of each transmit/receive module to be used, a suitable density of transmit/receive modules can be determined.

The skilled person will appreciate that, by not using a low density of very high power transmit/receive modules, which are each very expensive, and instead using a higher density of low to medium power transmit/receive modules, which are comparably much cheaper, the overall cost of the antenna can be reduced without compromising the power rating of the antenna as a whole.

A skilled person will also appreciate that the above is only possible with physically compact transmit/receive modules and radiating elements, which is provided in the two-chip solution suggested above. The design of a suitable compact radiating element is the subject of GB patent application no. 0523818.3 entitled "Antennas".

The skilled person would readily appreciate that the above embodiment can be altered without departing from the scope of the planned invention defined by the claims. For instance, various radiating elements, transmit/receive modules and array phased configurations can be utilised whilst falling within the scope of the present invention.

Further, the array may be configured such that the radiating elements 410 are based on linear structures that are aligned vertically or in any other suitable arrangement.

The skilled person will appreciate that the dimensions of spacing D between each radiating element are not necessarily the same in both the vertical and horizontal dimensions.

Further, the skilled person would also appreciate that the exact construction of the radiating elements connections to the transmit/receive modules can be altered whilst still utilising the solution of the present invention, which is to reduce the cost of the transmit/receive modules such that it is possible to utilise a larger concentration of these modules to achieve the same overall power per unit area of an array antenna.

An important aspect of the present invention is that the cost reductions achievable by the use of highly integrated, low power transmit/receive modules (even in the larger numbers required) are significant compared to conventional techniques based on smaller numbers of high power modules, due principally to the disproportionately high cost of high power modules.

The invention claimed is:

1. A high-power phased array antenna comprising:

an array of radiating elements; and a low power communication module connected to each radiating element, and at least one combining element that receives an output of each low-power communication module and communicates with a processor of the array, wherein said radiating elements are spaced apart horizontally and vertically in the array by predetermined amounts D1 and D2, respectively, wherein D1 and D2 are directly proportional to each of a power requirement value of the array antenna and a power per unit area value for achieving the power requirement, and wherein a power density of said low-power communication modules is directly proportional to each of the power requirement of the array antenna and the spacing of said radiating elements, and indirectly proportional to a power value of each low power communication module.

2. The high-power phased array antenna according to claim 1 wherein each low-power communication module is one of a transmit module, a receive module, or a transmit/receive module.

3. The high-power phased array antenna according to claim 1 wherein each low-power communication module is a transmit or a transmit/receive module.

4. The high-power phased array antenna according to claim 1, wherein each low-power communication module is a single chip performing at least one of amplification, gain control and phase control at the operating frequency of the array antenna.

5. The high-power phased array antenna according to claim 1, wherein each low-power communication module is a two-chip arrangement, wherein the chips in the arrangement are separated by a ceramic shelf.

6. The high-power phased array antenna according to claim 1, wherein D1 and D2 are equal.

7. The high-power phased array antenna according to claim 1, wherein D1 and D2 are not equal.

8. The high-power phased array antenna according to claim 1, wherein adjacent rows of radiating elements are not aligned in the vertical direction.

9. The high-power phased array antenna according to claim 1, wherein a horizontal spacing between radiating elements in a first row is offset from the horizontal spacing between radiating elements in an adjacent row by a predetermined amount.

10. The high-power phased array antenna according to claim 1, wherein when the at least one combining element includes plural combining elements an output of said plurality of combining element is combined.

* * * * *